US009021835B2

(12) United States Patent
Babyak

(10) Patent No.: US 9,021,835 B2
(45) **Date of Patent: *May 5, 2015**

(54) REMOVABLE JEWELRY SETTING

(71) Applicant: Babyak Holdings, LLC, Plantation, FL (US)

(72) Inventor: Josh Babyak, Plantation, FL (US)

(73) Assignee: Babyak Holdings, LLC, Plantation, FL (US)

( * ) Notice: Subject to any disclaimer, the term of this patent is extended or adjusted under 35 U.S.C. 154(b) by 93 days.

This patent is subject to a terminal disclaimer.

(21) Appl. No.: 13/856,249

(22) Filed: Apr. 3, 2013

(65) Prior Publication Data

US 2013/0291588 A1 Nov. 7, 2013

Related U.S. Application Data

(63) Continuation-in-part of application No. 12/900,523, filed on Oct. 8, 2010, now Pat. No. 8,434,327, which is a continuation-in-part of application No. 12/798,503, filed on Apr. 5, 2010, now abandoned.

(51) Int. Cl.

| | |
|---|---|
| ***A44C 17/02*** | (2006.01) |
| ***A43C 7/04*** | (2006.01) |
| ***A44B 11/06*** | (2006.01) |
| ***G04B 47/04*** | (2006.01) |

(52) U.S. Cl.

CPC ..... *A44C 17/0208* (2013.01); *A44B 11/06* (2013.01); *G04B 47/042* (2013.01)

(58) Field of Classification Search

USPC ..... 63/29.1; 24/3.12, 712.1

See application file for complete search history.

(56) References Cited

U.S. PATENT DOCUMENTS

| | | | | |
|---|---|---|---|---|
| 819,884 | A * | 5/1906 | Higgins | 24/712.6 |
| 899,296 | A | 9/1908 | Elliot | |
| 1,152,340 | A | 8/1915 | Obsbourn | |
| 2,253,343 | A | 8/1941 | Nalick | |
| 2,271,133 | A | 1/1942 | Thoresen | |
| 2,316,225 | A | 4/1943 | Hoffman et al. | |
| 2,354,513 | A | 7/1944 | Fitzer | |
| 2,537,445 | A | 1/1951 | Couture | |
| 3,115,758 | A | 12/1963 | Eberle et al. | |
| 3,509,734 | A | 5/1970 | Lederer | |
| 3,605,438 | A | 9/1971 | Chalson | |
| 4,387,489 | A * | 6/1983 | Dudek | 24/133 |
| 4,393,667 | A | 7/1983 | Reinstein et al. | |
| 4,794,766 | A | 1/1989 | Schunk et al. | |

(Continued)

FOREIGN PATENT DOCUMENTS

| | | |
|---|---|---|
| GB | 1413090 | 11/1975 |

*Primary Examiner* — Jack W Lavinder

(74) *Attorney, Agent, or Firm* — McHale & Slavin, P.A.

(57) ABSTRACT

The present invention provides an improvement in an article of jewelry of the type in which the ornamental portion of the article is secured or released selectively from the support portion of the article. The removable jewelry setting provides a simplified construction which is used readily by the wearer of jewelry to assemble a particular combination of ornament and support selected from a wide variety of such combinations made available by the improvement. The construction also enhances the ability to tailor a jewelry article to a particular style of dress without unduly multiplying the number of expensive ornaments required to provide a wide range of ornamented articles. The construction enables ease of interchange of the ornamental portion of an article of jewelry.

13 Claims, 12 Drawing Sheets

(56) References Cited

U.S. PATENT DOCUMENTS

| | | | | | |
|---|---|---|---|---|---|
| 5,471,713 | A | * | 12/1995 | Alter et al. | 24/136 R |
| 5,631,879 | A | * | 5/1997 | Pequignet | 368/282 |
| 5,718,021 | A | * | 2/1998 | Tatum | 24/712.2 |
| 6,108,276 | A | | 8/2000 | Chen | |
| 6,130,861 | A | | 10/2000 | Della Felice | |
| 7,249,397 | B2 | | 7/2007 | Abels et al. | |
| 7,650,706 | B2 | * | 1/2010 | Wartel et al. | 36/54 |
| 8,434,327 | B2 | * | 5/2013 | Babyak | 63/29.1 |
| 8,739,373 | B1 | * | 6/2014 | Berman | 24/712.6 |
| 2006/0083115 | A1 | * | 4/2006 | Lafever et al. | 368/282 |

* cited by examiner

REMOVABLE JEWELRY SETTING

CROSS REFERENCE TO RELATED APPLICATIONS

In accordance with 37 C.F.R 1.76, a claim of priority is included in an Application Data Sheet filed concurrently herewith. Accordingly, under 35 U.S.C. §119(e), 120, 121, and/or 365(c) the present invention claims priority as a continuation-in-part to U.S. Nonprovisional Utility application Ser. No. 12/900,523, filed Oct. 8, 2010, entitled, "REMOVABLE JEWELRY SETTING", which is a continuation-in-part to U.S. Nonprovisional Utility application Ser. No. 12/798,503, filed Apr. 5, 2010, entitled, "LACE LOCK DEVICE", which is now abandoned. The contents of each of the above referenced applications are herein incorporated by reference in its entirety.

FIELD OF THE INVENTION

The present disclosure relates to articles of jewelry, and more specifically, the present disclosure relates to a jewelry setting that may be affixed to various other articles of jewelry or clothing to enhance the visual appearance thereof.

BACKGROUND OF THE INVENTION

The use of jewelry to accent and complement various styles of dress requires variety in the design and appearance of jewelry pieces. Thus, the most desirable wardrobes include many articles of clothing and/or jewelry, leading to considerable expense, in purchase as well as in upkeep and storage. Since the ornamental portion of a jewelry piece, such as a gemstone in a setting, often is the most dramatic element of the piece, and the most expensive element, it has been suggested that the versatility of jewelry can be increased, while expense can be reduced, by providing for the selective interchange of the ornamental portion from piece to piece. In that manner, a particularly prized ornament, such as a highly precious gemstone or arrangement of gemstones, can be secured, selectively, to any one of a variety of shoes, hats, clothing, pins, earrings, bracelets, necklaces and the like, thereby increasing the versatility of the gemstone while at the same time reducing the expenses of purchasing and maintaining a complete and flexible wardrobe. However, the interchangeability accomplished by the prior art structures are mostly for the convenience of the commercial supplier of jewelry, and not necessarily for the placement of a more versatile wardrobe in the hands of an individual end user. Consequently, the suggested constructions are relatively complex and are not easily operated by the person who will wear the jewelry.

DESCRIPTION OF THE PRIOR ART

Removable or interchangeable jewelry settings have been proposed in the prior art. In general, interchangeable jewelry has concentrated on changing the stones on a particular piece of jewelry, such as a ring or earring, and has ignored the possibility of constructing a jeweled setting that is directly attachable to articles of clothing, as well as various types of articles of jewelry.

For example, U.S. Pat. No. 4,393,667 discusses a construction in which jeweled settings can be interchanged. Various arrangements are disclosed for accomplishing interchangeability.

U.S. Pat. No. 4,794,766 discloses an interchangeable stone held in place by clamps which are under tension by ornamental screws while, U.S. Pat. No. 3,605,438 discloses settings on a bar pin where the bar pin extends through an ornamental background and the settings, including ornamental backgrounds, can be mixed and matched. They are held in place by a spring clip over the bar pin.

U.S. Pat. Nos. 899,296; 1,152,340; and 2,316,225 disclose a stone setting that can be removed for various split and hinged rings. U.S. Pat. No. 2,537,445 discloses settings which can be snapped or screwed into place. U.S. Pat. No. 3,509,734 discloses a setting held in place magnetically. U.S. Pat. No. 3,115,758 discloses a setting held in place by a spring loaded mount. U.S. Pat. No. 2,253,343 discloses an emblem held on a ring by screws, and U.S. Pat. No. 2,354,513 discloses a setting with a bar pin held in place by a set screw in the ring.

As demonstrated by the prior art, conventional changeable settings generally are required to include small removable parts which are easily lost and are designed so that all except the nimblest of fingers can work the design. Therefore, conventional changeable settings do not meet the need for an uncomplicated and low cost manner for providing a means to mix and match settings within a single piece of jewelry with few parts to lose, and which is easily manipulated by the public.

Golf is a game that originated in $15^{th}$ century Scotland. Since then, the popularity of golf has soared with over 50% of the world's golf courses located here in the United States. One of the attributes of the game of golf is marking the position of one player's ball so that another player may strike his ball without risk of hitting the first player's ball. Often a coin or a snap from a golfer's glove is used to mark the position of the player's ball. With the huge popularity of golf, not to mention the exclusivity of some golf clubs, marking a ball position with a coin or snap has become very mundane and many golfers would prefer something unique for a ball marker. The ball marker must be easily accessed for removal and replacement to its storage position. The ball marker should also be customizable for an individual golfer. The base portion of the ball marker should be attachable to various styles of shoes and clothing.

SUMMARY OF THE INVENTION

The present invention provides an improvement in an article of jewelry of the type in which the ornamental portion of the article is secured or released selectively from the support portion of the article, and attains several objects and advantages, some of which are summarized as follows: Provides a jewelry system of simplified construction which is used readily by the wearer of jewelry to assemble a particular combination of ornament and support selected from a wide variety of such combinations made available by the improvement; enhances the ability to tailor a jewelry article to a particular style of dress without unduly multiplying the number of expensive ornaments required to provide a wide range of ornamented articles; opens new fields of fashion by rendering a wide variety of jewelry articles more available at lowered expense; provides a construction which is universal in the ability to accommodate almost any available ornamental element, including gemstones of essentially all sizes and cuts, so that the ornament is available for selection and placement by the wearer in combination with any one of a wide variety of supports; enables ease of interchange of the ornamental portion of an article of jewelry while providing a high degree of security once the ornamental portion is affixed to the support; avoids deleterious effects of stresses tending to distort the construction and impede ease of operation; and enables the construction of a highly desirable jewelry system of utmost quality and exemplary performance over a long service life.

Accordingly, it is an objective of the present invention to provide a removable jewelry setting.

It is a further objective of the present invention to provide a removable jewelry setting that includes a releasable and lockable upper body portion to allow the setting to be secured to an elongated member.

It is yet another objective of the present invention to provide a removable jewelry setting that includes an internal channel for cooperating with an elongated member.

It is a still further objective of the present invention to provide a removable jewelry setting with outwardly mounted stabilizers to prevent rotation of the jewelry setting about the elongated member to which it is mounted.

A still further objective of the present invention is to provide a removable jewelry setting that includes removable and replaceable stabilizers for enhanced visual appearance and ease of attaching the jewelry setting to a desired elongated object.

An even further objective of the present invention to provide a removable jewelry setting that includes a removable ball marker for the game of golf.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1A:
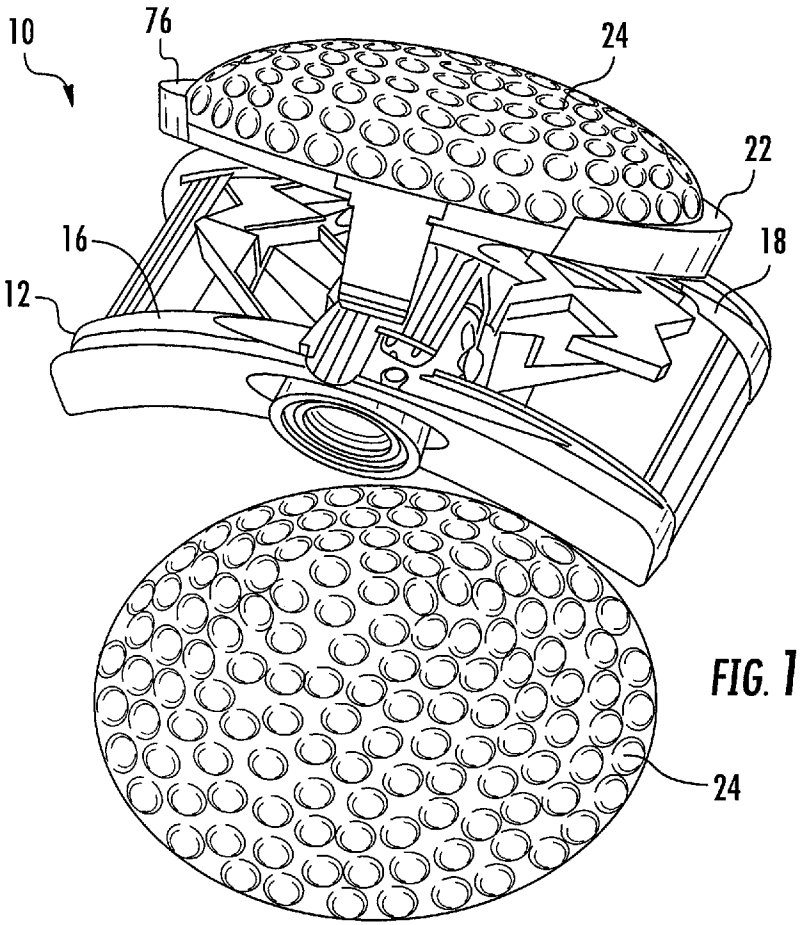
FIG. 1A is a front perspective view of one embodiment of the removable jewelry setting.
Figure 1B:
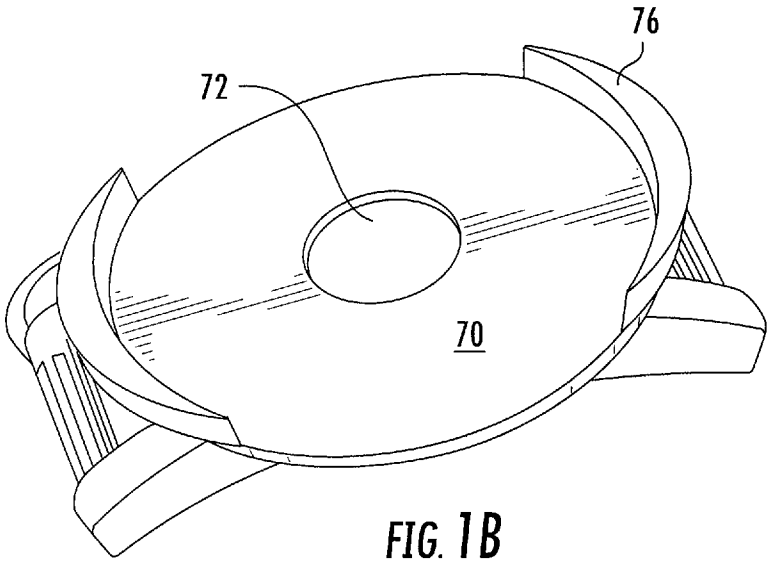
FIG. 1B is a front perspective view of the embodiment shown in FIG. 1, illustrated with the ball marker removed.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 7:
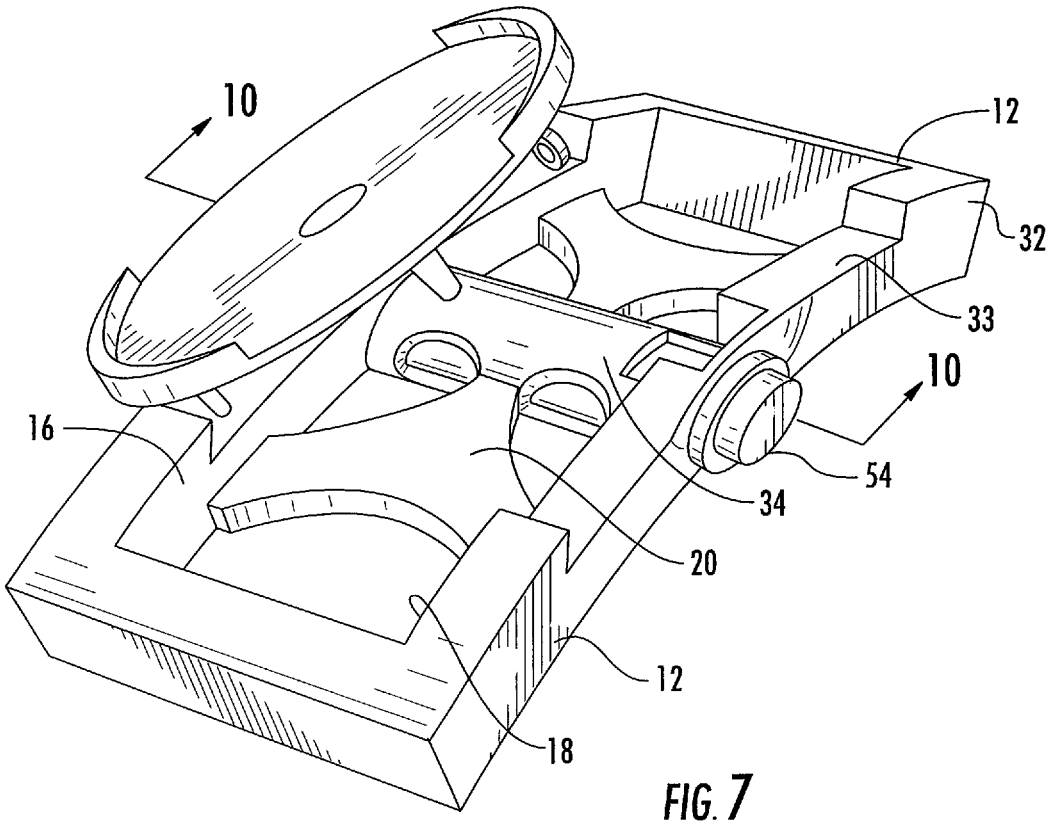
FIG. 7 is a front perspective view of an alternative embodiment of a removable jewelry setting.
Figure 8:
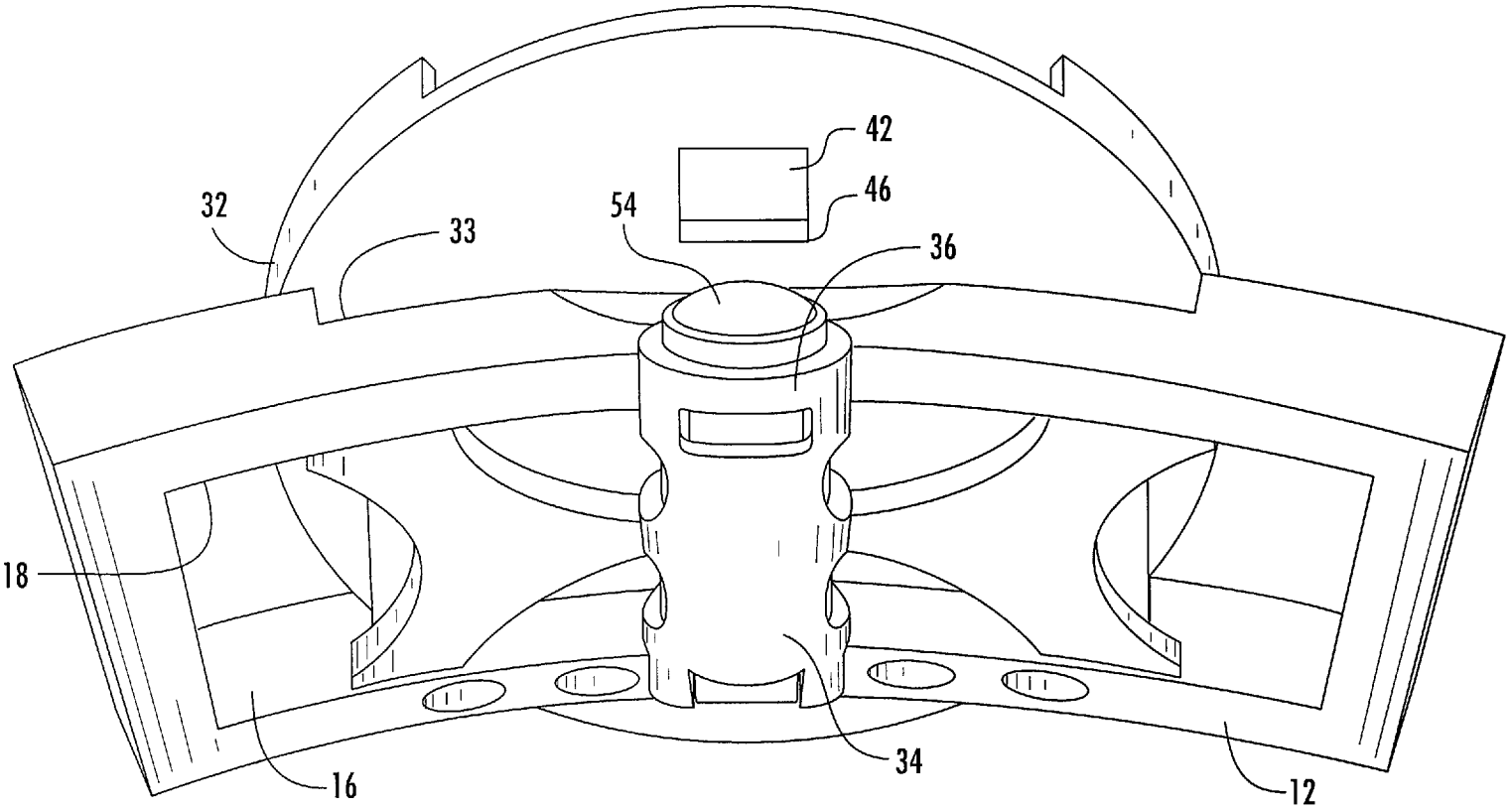
FIG. 8 is a rear perspective view of the embodiment illustrated in FIG. 7.

Referring generally to the Figures, various embodiments of a removable jewelry setting 10 are illustrated. The removable jewelry setting generally includes a lower body portion 12 pivotally connected to an upper body portion 22 and a latch assembly 28 for maintaining the assembly in a closed position while allowing access to the interior portion of the assembly when desired for attachment and removal of the jewelry setting. To accomplish these tasks, the lower body portion is provided with a channel 14 (FIGS. 12 and 13) extending through, at least, the length of the lower body portion covered by the upper body portion 22. The channel preferably includes two spaced apart side walls 16, 18 defining the width of the channel 14, and a lower wall 20 spaced apart from the upper body portion 22 to define the height of the channel. In at least one embodiment, the upper surface 32 of the lower body portion 12 includes a notch 33 to allow the upper body portion 22 to be recessed into the lower body portion 12. In addition to providing a different aesthetic appearance, this construction provides lateral stability to the upper body portion in a closed and/or open position as illustrated in FIGS. 7 and 8.

Figure 9:
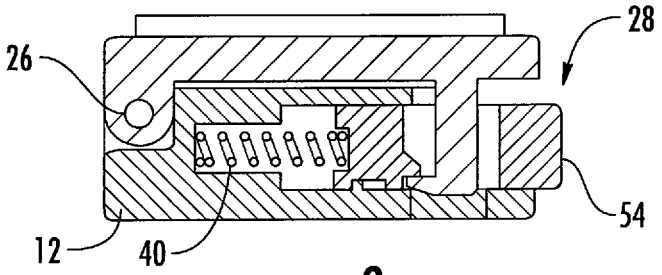
FIG. 9 is a section view taken along lines 9-9 of FIG. 2.
Figure 10:
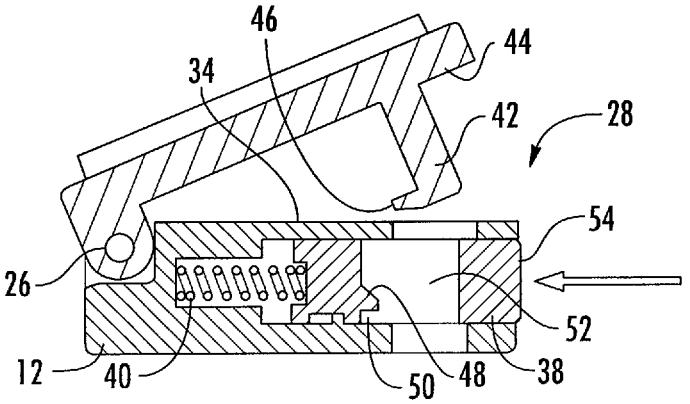
FIG. 10 is a section view taken along lines 10-10 of FIG. 7.
Figure 11:
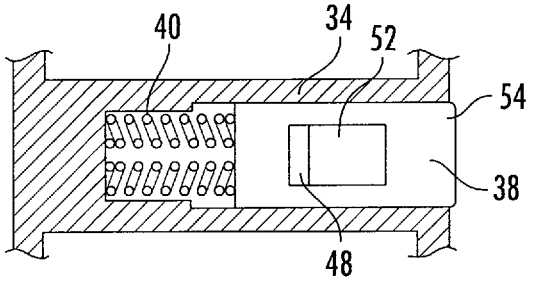
FIG. 11 is a partial section view taken along lines 11-11 of FIG. 3.

Referring to FIGS. 7-14, the lower wall 20 is preferably integrally formed between the side walls 16, 18 to provide rigidity to the lower body portion. Formed in the central portion of the lower wall is the latch housing 34. The latch housing is preferably formed as a tubular conduit positioned substantially transverse with respect to the channel 14 to contain a spring latch assembly 36. The spring latch assembly includes at least one spring member 40 and a sliding latch body 38 positioned to cooperate with a pawl member 42. The sliding latch body is preferably formed to include a shape that prevents rotation within the latch housing and includes a depression 52 therein that contains a catch 50. The catch is positioned within the depression for engagement with the pawl member 42. The pawl member is positioned on a lower surface 44 of the upper body portion 22 and preferably includes a first ramp surface 46 that is constructed and arranged to cooperate with a second ramp surface 48 on the catch 50 to cause movement of the sliding latch assembly 36 thereby compressing spring members 40. Upon passing the ramp surface, the compressed springs are released to cause the catch 50 to engage the pawl 42 to maintain the assembly in a closed position (FIG. 9). In a most preferred embodiment, a manually engagable actuating portion, illustrated herein as a button 54 that extends through a side wall of said lower body portion is provided for easy release of the latch assembly. In this manner the removable jewelry setting can be opened for insertion of an elongated member 56 into the channel and closed to lock the jewelry setting 10 to the elongated member. Removal merely requires the upper body portion to be released via the sliding latch assembly 36 to remove the jewelry setting for attachment to another elongated member. It should also be noted that in some embodiments the latch housing 34 extends a predetermined distance into the channel 14 to function as a pinch point (see FIGS. 12 and 13) between the lower wall 20 and the lower surface 44 of the upper body portion 22 to prevent the removable jewelry setting 10 from sliding along the elongated member 56 when positioned within the channel 14.

Figure 2:
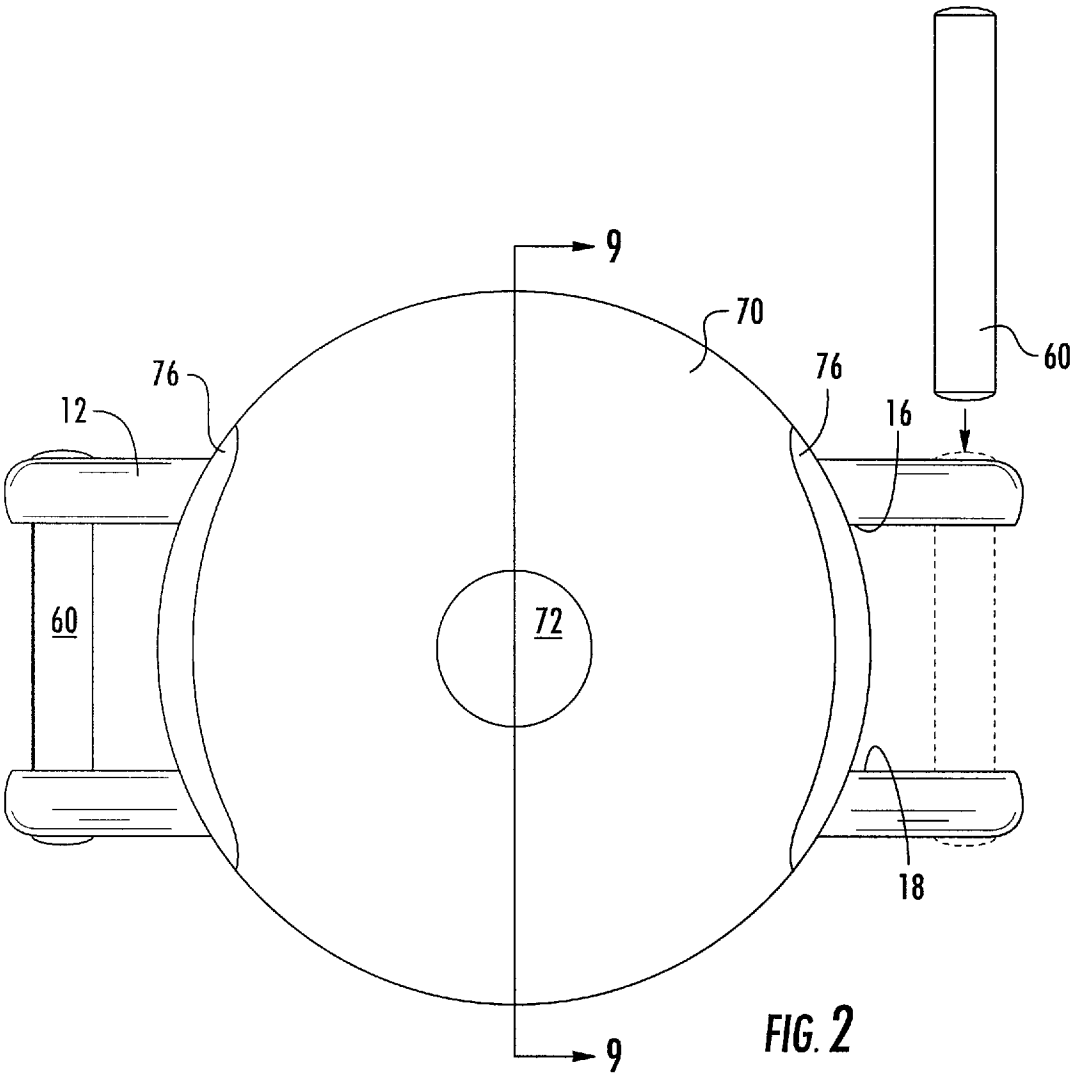
FIG. 2 is a front view of the embodiment illustrated in FIG. 1.
Figure 3:
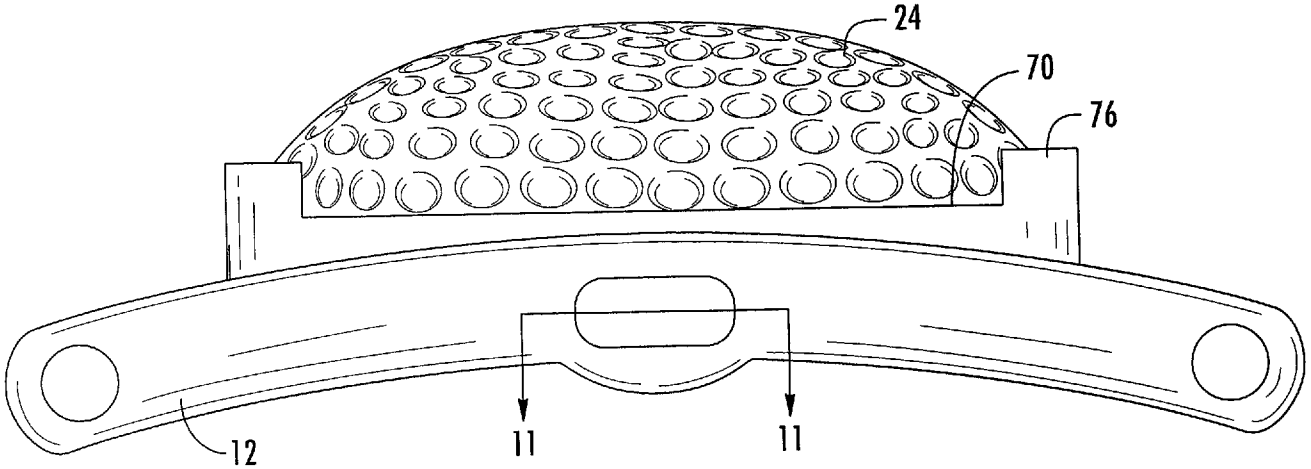
FIG. 3 is a top view of the embodiment illustrated in FIG. 1.
Figure 4:
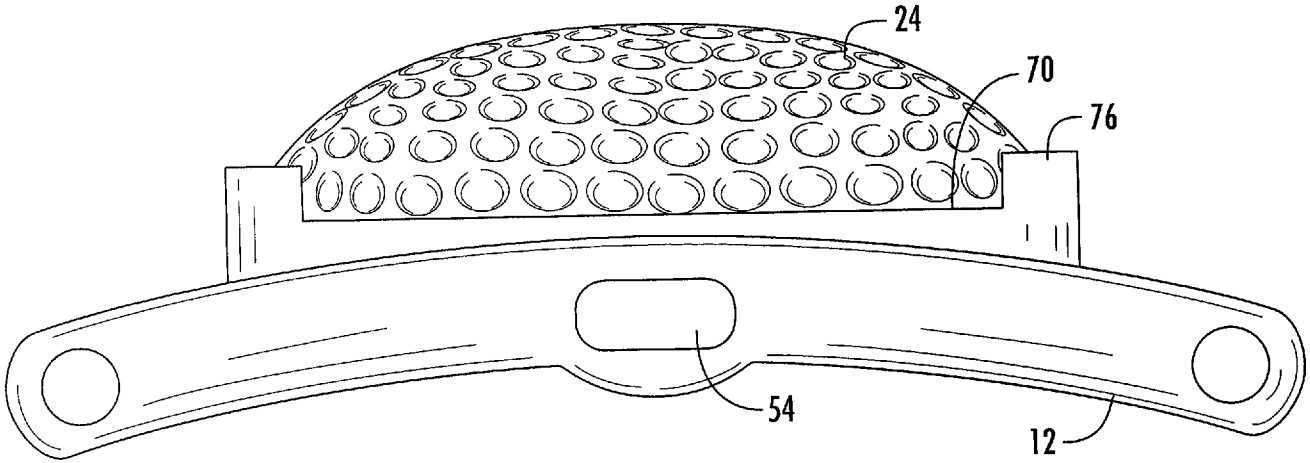
FIG. 4 is a bottom view of the embodiment illustrated in FIG. 1.
Figure 5:
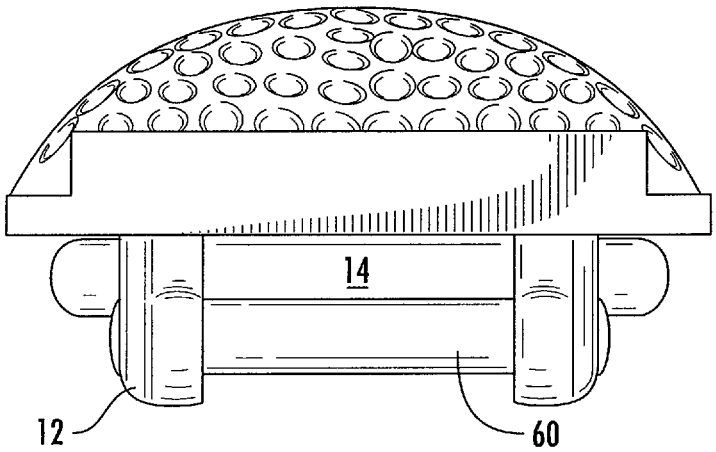
FIG. 5 is a left end view of the embodiment illustrated in FIG. 1.
Figure 6:
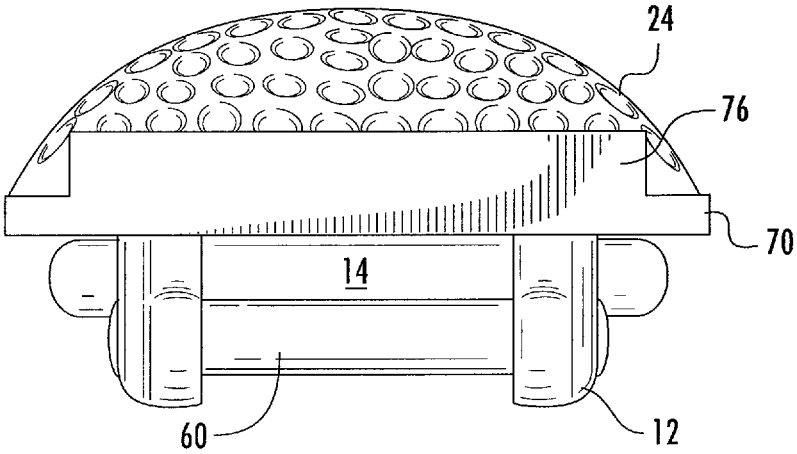
FIG. 6 is a right end view of the embodiment illustrated in FIG. 1.
Figure 12:
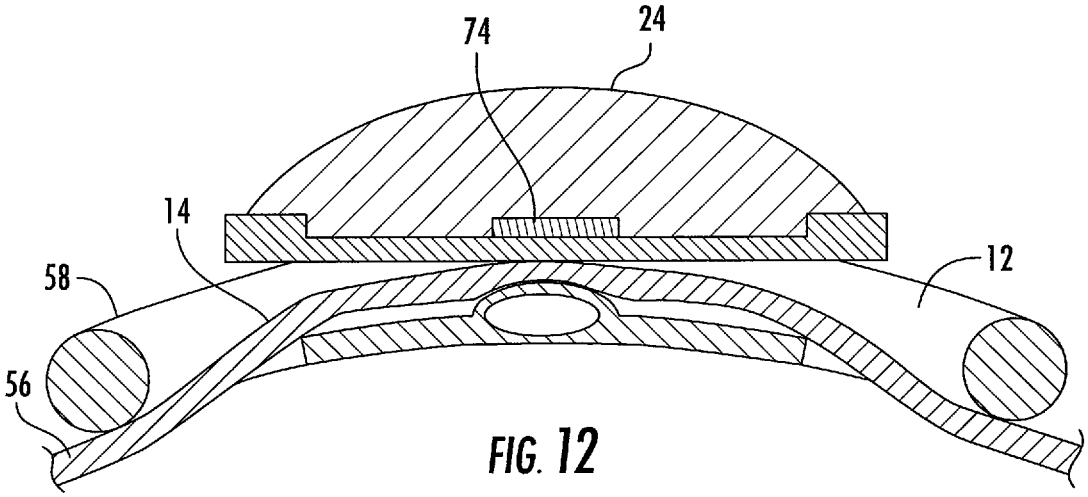
FIG. 12 is a partial section view taken along lines 12-12 of FIG. 16.
Figure 13:
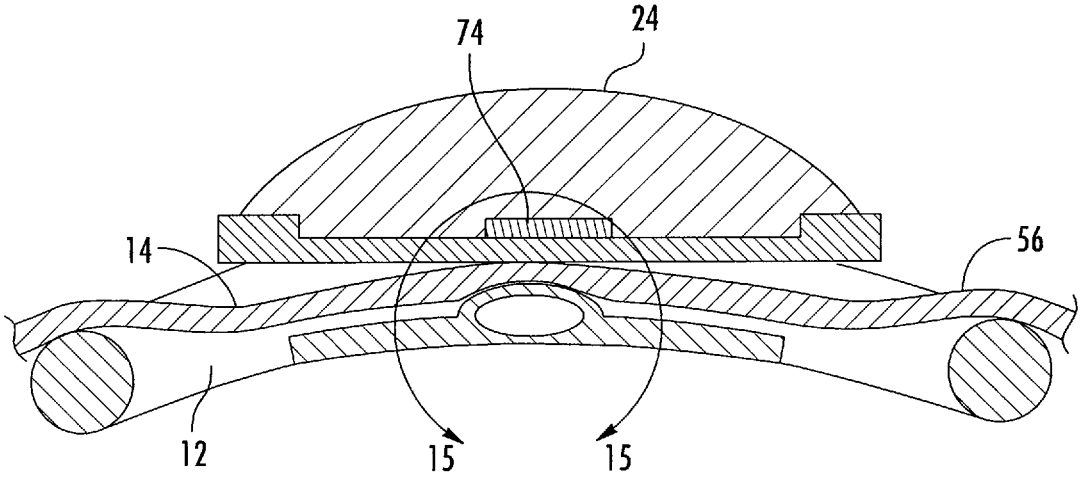
FIG. 13 is a partial section view taken along lines 12-12 of FIG. 16 illustrating an alternative path for threading the elongated member through the removable jewelry setting.
Figure 14:
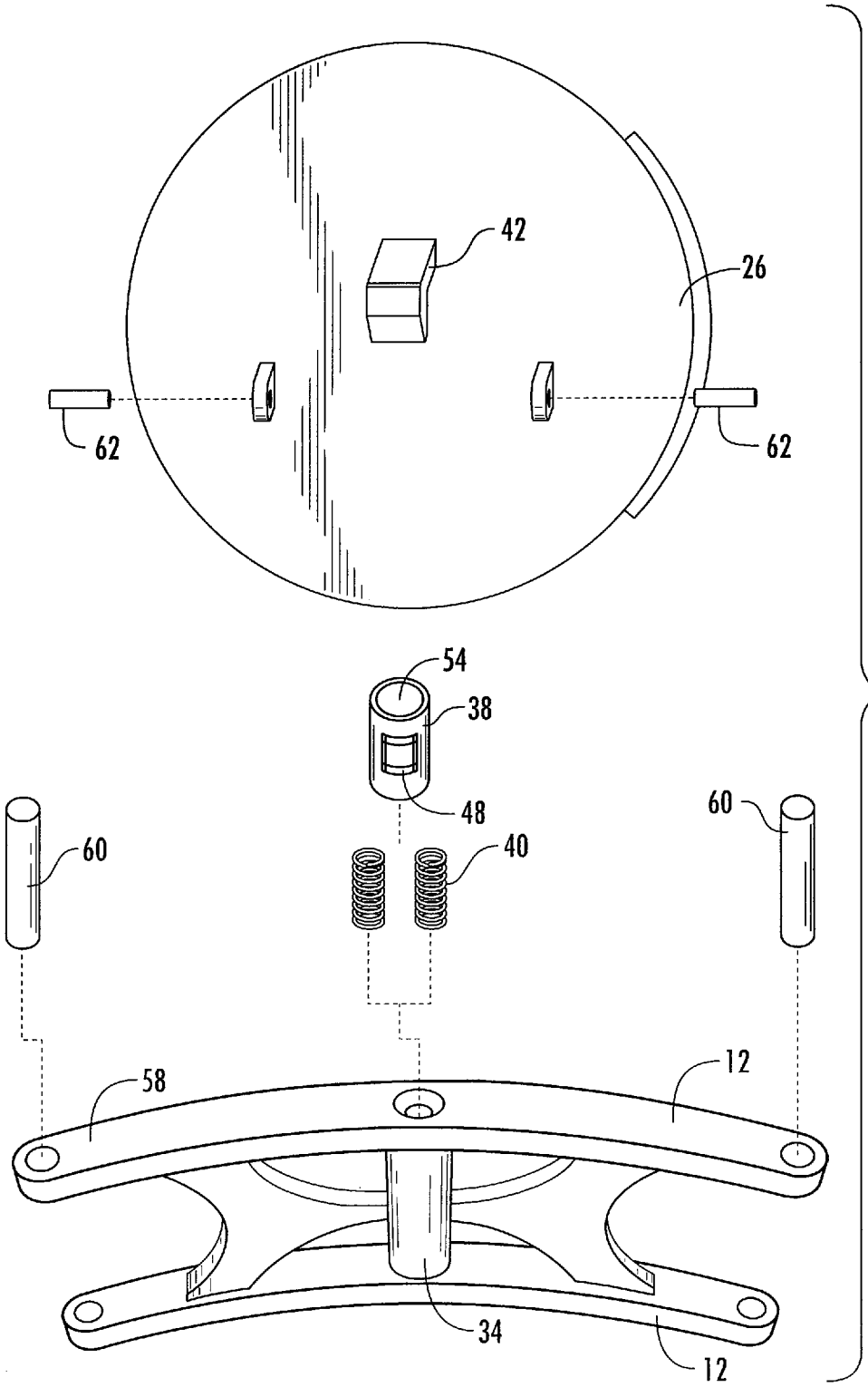
FIG. 14 is an exploded view of the embodiment illustrated in FIG. 1.
Figure 15:
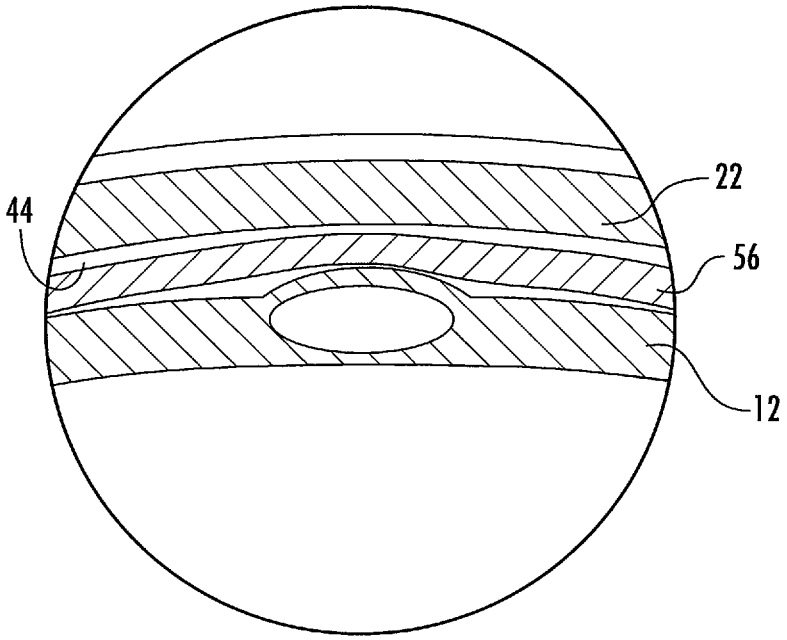
FIG. 15 is a partial section view taken along lines 15-15 of FIG. 13.

Referring to FIGS. 1-26, the lower body portion 12 includes a length that is longer than the upper body portion 22 so that a portion of the lower body extends outward with respect to each end of the upper body portion. Each outward extending portion 58 of the lower body preferably includes a stabilizer member 60. Each stabilizer member is preferably arranged substantially perpendicular with respect to the channel, and each stabilizer member includes at least one surface constructed and arranged to cooperate with an elongated member 56 positioned in the channel to prevent rotation of the removable jewelry setting 10 about the elongated member. In at least one embodiment, the stabilizer members 60 are positioned a sufficient distance outward with respect to said upper body portion to allow the elongated member 56 to be routed over or under each of the stabilizer members and through the channel for different appearances as shown in FIGS. 12 and 13. In addition, the stabilizer members 60 may be removable and replaceable as illustrated in FIGS. 2 and 14 for different appearance or assembly to an elongated member.

Referring generally to the Figures, the upper body portion 22 preferably includes a table 70 sized and shaped to support a ball marker 24. The ball marker may be constructed of various materials to include precious stones, plated or painted materials. It should also be noted that the upper surface of the table 70 may include paints, plating or other surface coating(s) well known in the art for decorating jewelry and personal adornments. Preferably, the ball marker is secured to the table 70 with magnet 72 which is embedded into the table. A piece of iron, steel or the like 74 (FIGS. 12 and 13) is secured onto or into the rear surface of the ball marker 24 to cooperate with the magnet 72. In at least one embodiment, perimeter rails 76 are used to control the positioning of the ball marker with respect to the table 70. The rails 76 are preferably constructed from same material as the table 70 and include sufficient height to extend over the perimeter edge of the ball marker 24. In some embodiments, the perimeter rails may include undercuts or the like which require the ball marker to be shifted for removal. It should be noted that while the magnet is depicted and described as being secured to the table, the magnet may be secured to the rear surface of the ball marker and the iron or steel to the table without departing from the scope of the invention. It should also be noted that while the combination of a magnet and iron or steel are described as the preferred embodiment, snaps, hook and loop, latches, catches or the like may be used to secure the ball marker to the table without departing from the scope of the invention so long as they permit easy removal and replacement of the ball marker as desired. The upper body portion is preferably pivotally connected via a pin type hinge 26 (FIGS. 9 and 10) to one of said side walls 16, 18 via pins 62 for movement between an open position and a closed position. It should be noted that the pin type hinge assembly 26 may be replaced with any number of hinges, well known in the art, without departing from the scope of the invention.

Figure 16:
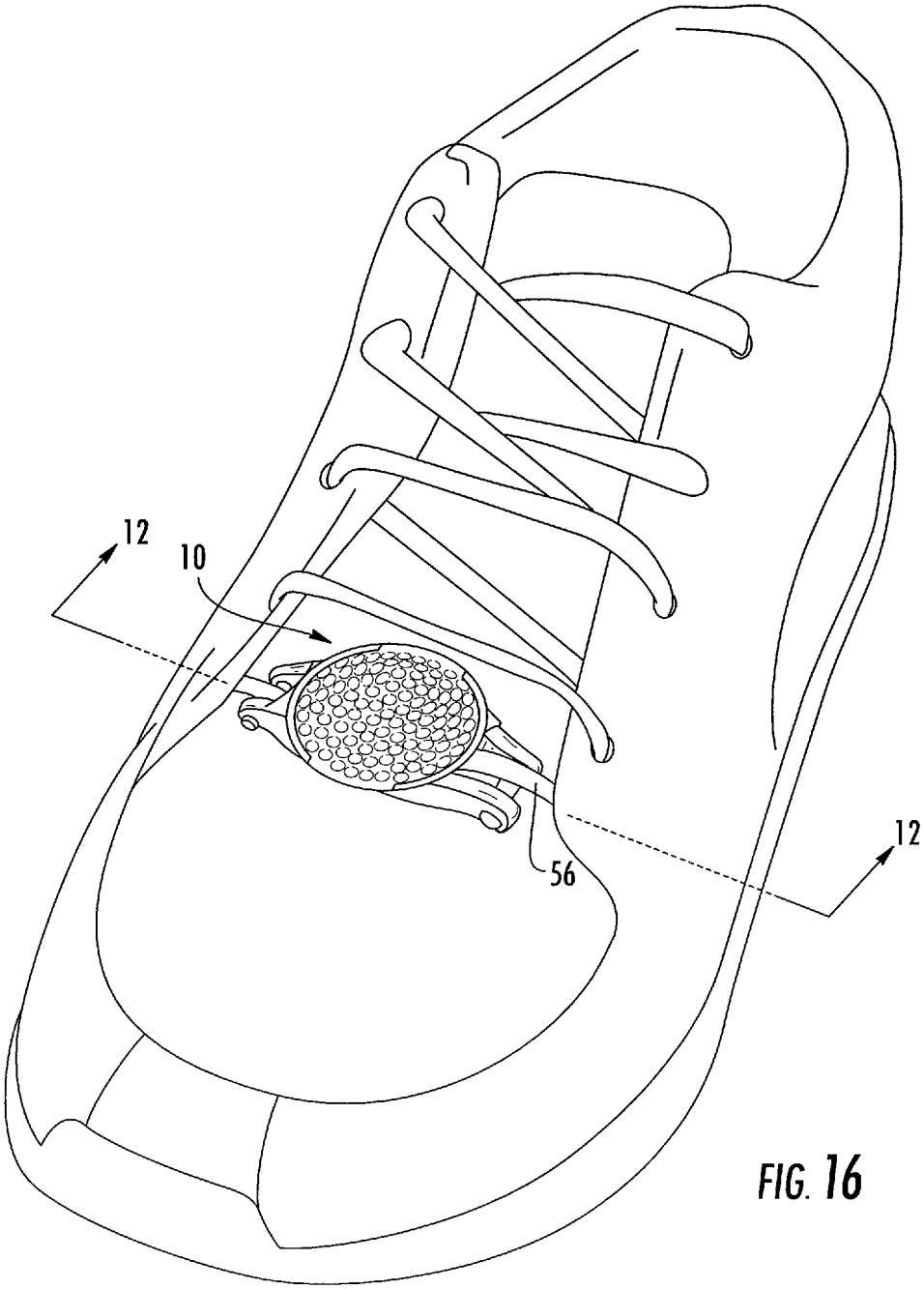
FIG. 16 is a perspective view illustrating one embodiment of the removable jewelry setting secured to a shoe lacing.

Referring to FIG. 16, one embodiment of the removable jewelry setting secured to a hat 76 is illustrated with a ball marker secured thereto.

Figure 17:
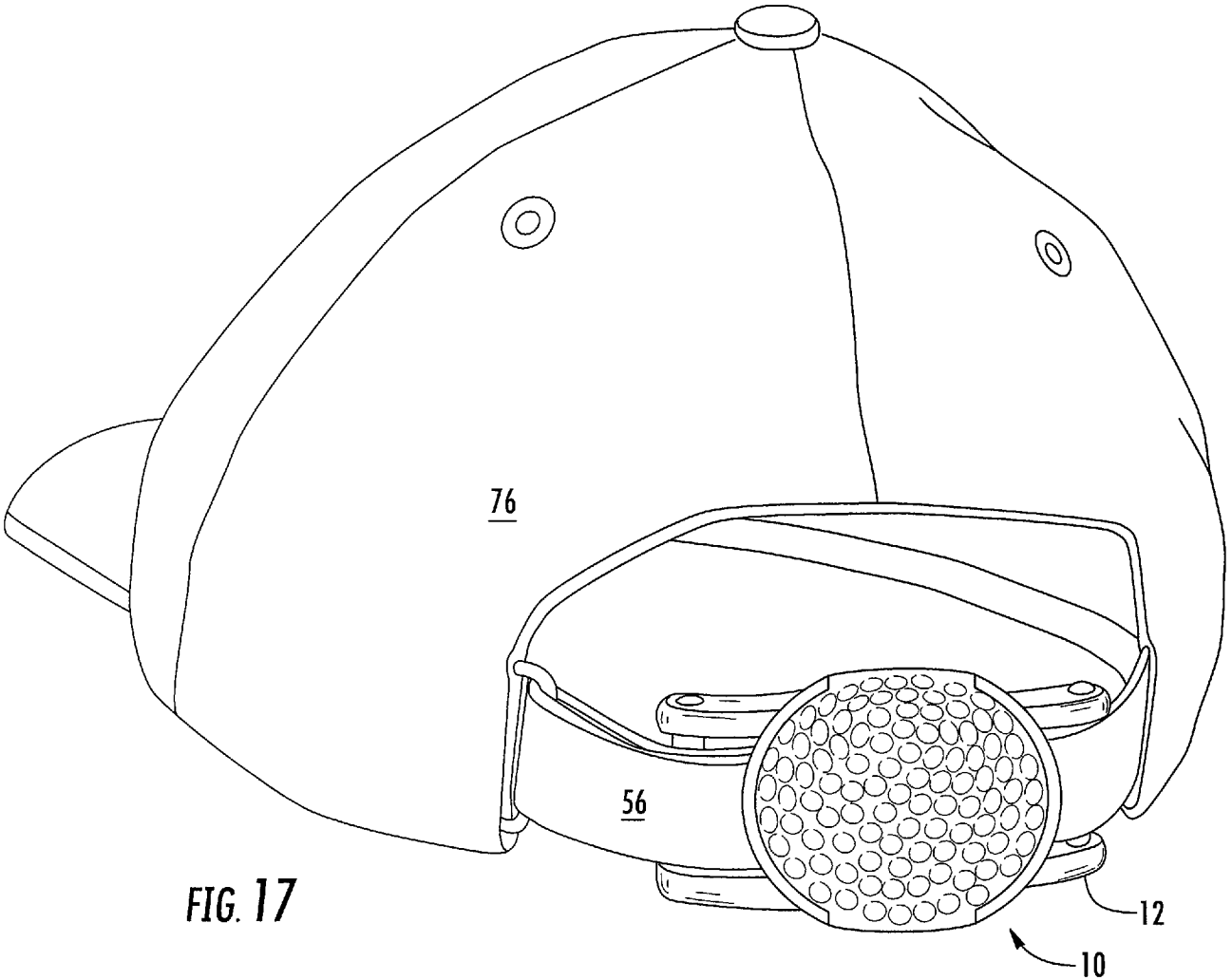
FIG. 17 is a perspective view illustrating one embodiment of the removable jewelry setting secured to a hat.

Referring to FIG. 17, one embodiment of the removable jewelry setting secured to a hat 76 is illustrated with a ball marker secured thereto.

All patents and publications mentioned in this specification are indicative of the levels of those skilled in the art to which the invention pertains.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A removable jewelry setting comprising:

a lower body portion having a channel extending therethrough, said channel including at least two spaced apart side walls defining a width of said channel and a lower wall spaced apart from an upper body portion to define a height of said channel, an upper body portion including a table for securing decoration thereon, said upper body portion pivotally connected to one of said side walls for movement between an open position and a closed position, said lower body portion including a length that is longer than said upper body portion, a portion of said lower body extending outward with respect to each end of said upper body portion, a releasable latch assembly, said latch assembly being constructed and arranged to cooperate with said upper body portion and said lower body portion to retain said upper body portion in said closed position, said latch assembly being releasable to allow an elongated member to be placed in said channel, whereby pivoting said upper body portion to said closed position secures said removable jewelry setting around said elongated member.

2. The removable jewelry setting of claim 1 wherein said table include a golf ball marker secured thereto.

3. The removable jewelry setting of claim 1 wherein said ball marker is secured to said table with a magnet.

4. The removable jewelry setting of claim 1 wherein said latch assembly is manually releasable and includes a manually engagable actuating portion extending through a side wall of said lower body portion.

5. The removable jewelry setting of claim 4 wherein said latch assembly is a sliding spring latch assembly, said spring latch assembly including a sliding latch body having a depression therein, a catch positioned within said depression for facilitating engagement with a pawl, a spring member connected to said latch body and said lower body portion for biasing said latch body to a latched position, said pawl positioned on a lower surface of said upper body portion.

6. The removable jewelry setting of claim 5 wherein said lower body portion includes a tubular conduit for containing said spring latch assembly, said tubular conduit positioned substantially transverse with respect to said channel.

7. The removable jewelry setting of claim 6 wherein said tubular conduit extends a predetermined distance into said channel to function as a pinch point between said lower body portion and said upper body portion to prevent said removable jewelry setting from sliding along said elongated member when positioned within said channel.

8. The removable jewelry setting of claim 1 wherein each said outward extending portion of said lower body portion includes a stabilizer member, each said stabilizer member arranged substantially perpendicular with respect to said channel, each said stabilizer member including at least one surface constructed and arranged to cooperate with an elongated member positioned in said channel to prevent rotation of said removable jewelry setting about said elongated member.

9. The removable jewelry setting of claim 8 wherein said stabilizer members are removable and replaceable.

10. The removable jewelry setting of claim 8 wherein said elongated member may be routed over or under each said stabilizer member and through said channel for different appearances.

11. The removable jewelry setting of claim 1 wherein said mounting is constructed and arranged to retain at least one cabochon stone.

12. The removable jewelry setting of claim 2 wherein said ball marker is constructed to include at least one semi-precious stone.

13. The removable jewelry setting of claim 1 wherein said ball marker is constructed to include at least one precious stone.

* * * * *